US009534565B2

(12) United States Patent
Horiba et al.

(10) Patent No.: US 9,534,565 B2
(45) Date of Patent: Jan. 3, 2017

(54) EVAPORATED-FUEL PROCESSING APPARATUS

(71) Applicant: HONDA MOTOR CO., LTD., Minato-Ku, Tokyo (JP)

(72) Inventors: Ayumu Horiba, Saitama (JP); Hiroshi Kitamura, Saitama (JP); Masakazu Kitamoto, Saitama (JP); Koichi Hidano, Saitama (JP); Mahito Shikama, Saitama (JP); Hiroaki Watanabe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 240 days.

(21) Appl. No.: 14/065,685

(22) Filed: Oct. 29, 2013

(65) Prior Publication Data

US 2014/0116402 A1 May 1, 2014

(30) Foreign Application Priority Data

Oct. 30, 2012 (JP) ..... 2012-239536
Oct. 30, 2012 (JP) ..... 2012-239537
Oct. 30, 2012 (JP) ..... 2012-239538

(51) Int. Cl.
*F02M 25/08* (2006.01)
*F02D 41/00* (2006.01)
*F02D 41/22* (2006.01)

(52) U.S. Cl.
CPC ..... *F02M 25/0836* (2013.01); *F02D 41/004* (2013.01); *F02M 25/089* (2013.01); *F02D 2041/225* (2013.01); *F02M 25/0809* (2013.01)

(58) Field of Classification Search
CPC ..... F02M 25/0854; F02M 25/0836; F02M 25/089; F02M 25/0809; F02M 33/02; F02D 19/0621; F02D 41/0037; F02D 41/0045; F02D 41/004
(Continued)

(56) References Cited

U.S. PATENT DOCUMENTS 6,988,396 B2 1/2006 Matsubara et al.
2004/0089275 A1* 5/2004 Kidokoro ..... F02M 25/0836 123/520
2008/0278300 A1* 11/2008 Deleon ..... B60K 15/0406 340/438

FOREIGN PATENT DOCUMENTS

JP S637268 1/1988
JP H08121279 A 5/1996
(Continued)

OTHER PUBLICATIONS

Office Action dated Sep. 29, 2015 for Japanese Patent Application No. 2012-239536.
(Continued)

*Primary Examiner* — Xiao Mo
(74) *Attorney, Agent, or Firm* — Carrier Blackman & Associates, P.C.; William D. Blackman; Joseph P. Carrier

(57) ABSTRACT

An evaporated-fuel processing apparatus including: a sealing valve which is arranged in a communication path between the atmosphere and a fuel tank mounted on a vehicle having an internal combustion engine, and shuts an internal space of the fuel tank off from the atmosphere; an open/close member which covers a fuel filling port of the fuel tank; a refueling-intention-information acquisition unit which acquires information indicating an intention of refueling; and a control unit which issues an opening command for opening the sealing valve when the refueling-intention-information acquisition unit acquires the information indicating an intention of refueling, and allows the open/close member to open when a time elapsed from the moment at which the opening command is issued exceeds a first predetermined time.

8 Claims, 6 Drawing Sheets

(58) Field of Classification Search
USPC ..... 123/516–520
See application file for complete search history.

(56) References Cited

FOREIGN PATENT DOCUMENTS

| | | | |
|---|---|---|---|
| JP | 2002370553 | A | 12/2002 |
| JP | 2004-156494 | A | 6/2004 |
| JP | 2006299994 | A | 11/2006 |
| JP | 2007009891 | A | 1/2007 |
| JP | 2012097661 | A | 5/2012 |
| JP | 2012112304 | A | 6/2012 |
| WO | 2012042615 | A1 | 4/2012 |

OTHER PUBLICATIONS

Office Action dated Sep. 29, 2015 for Japanese Patent Application No. 2012-239538.
Notice for Reasons for Refusal corresponding to Japanese Application No. 2012-239537 dated Feb. 23, 2016.
Office Action issued Oct. 20, 2015 in the corresponding Japanese Patent Application No. 2012-239537.
Notification of Reasons for Refusal dated Apr. 5, 2016 for corresponding Japanese Application No. 2012-239538.
Notification of Reasons for Refusal for corresponding Japanese Application No. 2012-239538 dated Nov. 8, 2016.

* cited by examiner

EVAPORATED-FUEL PROCESSING APPARATUS

BACKGROUND OF THE INVENTION

Field of the Invention

The present invention relates to an evaporated-fuel processing apparatus for processing evaporated fuel.

Description of the Related Art

For example, in vehicles having an internal combustion engine, when a fuel tank is refilled, the volume occupied by liquid fuel in the internal space of the fuel tank increases. Therefore, the volume of the vapor-phase region in the internal space decreases, so that the pressure of the vapor-phase region (which may be referred to as the tank internal pressure) becomes higher than the atmospheric pressure. Then, the evaporated fuel in the vapor phase staying in the fuel tank tends to be emitted to the atmosphere. If the evaporated fuel is emitted to the atmosphere, the atmosphere is polluted.

In order to prevent the air pollution caused by the emission of the evaporated fuel, in a conventional evaporated-fuel processing apparatus, a canister having absorbent which temporarily absorbs the evaporated fuel is arranged in a communication path between the fuel tank and the atmosphere, so that the evaporated fuel in the vapor phase overflown from the fuel tank is absorbed by the absorbent in the canister. That is, the conventional evaporated-fuel processing apparatus is configured to suppress the tank internal pressure while suppressing emission of the evaporated fuel to the atmosphere.

For example, Japanese Patent Laid-open No. 2004-156494 (which is hereinafter referred to as JP2004-156494A) discloses an evaporated-fuel processing apparatus in which a sealing valve for controlling the state of communication between the fuel tank and the canister is arranged in a flow path for the evaporated fuel realizing communication between the fuel tank and the canister. According to the evaporated-fuel processing technique disclosed in JP2004-156494A, when the internal combustion engine is stopped, the sealing valve is brought into a closed state, and the canister is opened to the atmosphere. In addition, when the internal combustion engine is stopped and a pressure difference exceeding a valve-opening threshold occurs between the tank internal pressure and the atmospheric pressure, the sealing valve is opened. Then, the change in the tank internal pressure which is caused by the opening of the sealing valve is detected. When the detected change in the tank internal pressure is smaller than a predetermined threshold, it is determined that a clogging failure (a failure in which the closed state continues) occurs in the sealing valve.

According to the evaporated-fuel processing technique disclosed in JP2004-156494A, the clogging failure of the sealing valve for sealing the fuel tank can be efficiently detected.

Further, according to the evaporated-fuel processing technique disclosed in JP2004-156494A, when an operator manipulates a lid switch, which is to be manipulated for unlocking a fuel lid covering a fuel filler port, first, the sealing valve is opened in order to prevent emission of the evaporated fuel through the fuel filler port to the atmosphere. The opening of the sealing valve causes a gradual decrease in the tank internal pressure. When the tank internal pressure is lowered to the vicinity of the atmospheric pressure, the fuel lid is unlocked. Thereafter, when the operator manually closes the fuel lid, the operator's manipulation is detected by an open/closed-state detector, and the sealing valve is closed.

However, according to the evaporated-fuel processing technique disclosed in JP2004-156494A, in the case where a failure in which the output value of a sensor detecting the tank internal pressure is stuck to a vicinity of the atmospheric pressure occurs, even when the tank internal pressure is actually high, the sensor outputs a wrong value indicating the tank internal pressure is in the vicinity of the atmospheric pressure, so that the fuel lid can be erroneously unlocked. As a result, it is impossible to perform refueling so as to prevent air pollution.

In view of above, the object of the present invention is to provide an evaporated-fuel processing apparatus which enables refueling so as to prevent air pollution.

SUMMARY OF THE INVENTION

In order to achieve the above object, the most essential feature of the evaporated-fuel processing apparatus according to the first aspect of the present invention is to include: a sealing valve which is arranged in a communication path between the atmosphere and a fuel tank mounted on a vehicle having an internal combustion engine, and shuts an internal space of the fuel tank off from the atmosphere; an open/close member which covers a fuel filling port of the fuel tank; a refueling-intention-information acquisition unit which acquires information indicating an intention of refueling; and a control unit which issues an opening command for opening the sealing valve when the refueling-intention-information acquisition unit acquires the information indicating an intention of refueling, and allows the open/close member to open when the time elapsed from a moment at which the opening command is issued exceeds a first predetermined time.

According to the first aspect of the present invention, a tank-internal-pressure detection unit is not included in the essential components. However, the tank-internal-pressure detection unit is not intentionally excluded from the essential components of the first aspect of the present invention. In other words, the first aspect of the present invention shall be understood to include an embodiment including the tank-internal-pressure detection unit and an embodiment which does not include tank-internal-pressure detection unit.

According to the first aspect of the present invention, the control unit issues the opening command for opening the sealing valve when the refueling-intention-information acquisition unit acquires the information indicating an intention of refueling, and allows the open/close member to open when the time elapsed from the moment at which the opening command is issued exceeds the first predetermined time. This is because when the time elapsed from the moment at which the opening command is issued exceeds the first predetermined time, the tank internal pressure can be normally expected to converge at such a level that refueling is not harmfully affected by the tank internal pressure.

Thus, the evaporated-fuel processing apparatus according to the first aspect of the present invention enables refueling so as to prevent air pollution without especially referring to the tank internal pressure.

The evaporated-fuel processing apparatus according to the second aspect of the present invention has the following additional feature as well as the features of the first aspect of the present invention. The additional feature of the evaporated-fuel processing apparatus according to the second aspect of the present invention is that the evaporated-fuel processing apparatus further includes a tank-internal-pressure detection unit which detects internal pressure of the fuel tank, and the control unit allows the open/close member to open when the internal pressure of the fuel tank converges in a predetermined pressure range and the time elapsed from the moment at which the opening command is issued exceeds the first predetermined time.

According to the second aspect of the present invention, the control unit allows the open/close member to open when the internal pressure of the fuel tank converges in a predetermined pressure range and the time elapsed from the moment at which the opening command is issued exceeds the first predetermined time. Specifically, the control unit can allow the open/close member to open when both of the tank-internal-pressure detection unit and a timer which counts the time elapsed from the moment at which the opening command is issued normally operate.

Thus, the evaporated-fuel processing apparatus according to the second aspect of the present invention has the advantages of the evaporated-fuel processing apparatus according to the first aspect of the present invention, and also has a fail-safe function in a sense that the open/close member is not incautiously opened.

The evaporated-fuel processing apparatus according to the third aspect of the present invention has the following additional feature as well as the features of the second aspect of the present invention. The additional feature of the evaporated-fuel processing apparatus according to the third aspect of the present invention is that the first predetermined time is set on the basis of a length of time which is estimated to be needed for convergence of the internal pressure of the fuel tank in the predetermined pressure range after the sealing valve is opened.

Thus, the evaporated-fuel processing apparatus according to the third aspect of the present invention has the advantages of the evaporated-fuel processing apparatus according to the second aspect of the present invention, and further enables control of opening of the open/close member at appropriate timing since the first predetermined time is set to an appropriate length of time.

The evaporated-fuel processing apparatus according to the fourth aspect of the present invention has the following additional feature as well as the features of the second aspect of the present invention. The additional feature of the evaporated-fuel processing apparatus according to the fourth aspect of the present invention is that the first predetermined time is set on the basis of a length of time which is estimated to be needed for the sealing valve to actually open after the opening command is issued.

Thus, the evaporated-fuel processing apparatus according to the fourth aspect of the present invention has the advantages of the evaporated-fuel processing apparatus according to the second aspect of the present invention, and also enables control of opening of the open/close member at appropriate timing, on the basis of the delay time which occurs when the sealing valve is opened.

The evaporated-fuel processing apparatus according to the fifth aspect of the present invention has the following additional feature as well as the features of the first aspect of the present invention. The additional feature of the evaporated-fuel processing apparatus according to the fifth aspect of the present invention is that the evaporated-fuel processing apparatus according to the fifth aspect of the present invention further includes a tank-internal-pressure detection unit which detects internal pressure of the fuel tank and a time-variation calculation unit which calculates an amount of time variation of the internal pressure of the fuel tank, and the control unit issues the opening command when the refueling-intention-information acquisition unit acquires the information indicating an intention of refueling, and allows the open/close member to open when the amount of time variation of the internal pressure of the fuel tank converges below a predetermined threshold.

According to the fifth aspect of the present invention, the control unit issues the opening command when the refueling-intention-information acquisition unit acquires the information indicating an intention of refueling, and allows the open/close member to open when the amount of time variation of the internal pressure of the fuel tank converges below a predetermined threshold. At this time, the time variation of the tank internal pressure can be calculated, for example, by obtaining a time derivative of the tank internal pressure, which varies with time. Although the scattering of detected values of the tank internal pressure can cause errors in determination of convergence of the tank internal pressure, such errors can be more suppressed in the case where convergence is determined on the basis of the time variation of the tank internal pressure than in the case where convergence is determined on the basis of the level of the tank internal pressure.

In the evaporated-fuel processing apparatus according to the fifth aspect of the present invention, refueling with prevention of air pollution can be performed smoothly and appropriately, compared with the configuration without the feature according to the fifth aspect of the present invention.

The evaporated-fuel processing apparatus according to the sixth aspect of the present invention has the following additional feature as well as the features of the fifth aspect of the present invention. The additional feature of the evaporated-fuel processing apparatus according to the sixth aspect of the present invention is that the control unit causes the time-variation calculation unit to start calculation of the amount of time variation of the internal pressure of the fuel tank after the time elapsed from the moment at which the opening command is issued exceeds the first predetermined time.

Immediately after the sealing valve is opened, the tank internal pressure varies (is lowered) relatively greatly. Therefore, even if the time variation of the tank internal pressure is calculated in an initial variation period immediately after the sealing valve is opened, it is unlikely that the tank internal pressure is determined to converge. Thus, it is possible to consider that the determination of convergence of the tank internal pressure is little affected even in the case where the time variation of the tank internal pressure is not calculated in the initial variation period. Therefore, according to the sixth aspect of the present invention, the control unit causes the time-variation calculation unit to start calculation of the amount of time variation of the internal pressure of the fuel tank after the time elapsed from the moment at which the opening command is issued exceeds the first predetermined time.

In the evaporated-fuel processing apparatus according to the sixth aspect of the present invention, the calculation of the time variation of the tank internal pressure is not performed for the first elapsed time (including the aforementioned initial variation period). That is, the unnecessary process for calculating the time variation is dispensed with. Therefore, the evaporated-fuel processing apparatus according to the sixth aspect of the present invention has an advantage of contribution to energy saving, in addition to the advantages of the fifth aspect of the present invention.

The evaporated-fuel processing apparatus according to the seventh aspect of the present invention has the following additional feature as well as the features of the fifth aspect of the present invention. The additional feature of the evaporated-fuel processing apparatus according to the seventh aspect of the present invention is that the first predetermined time is set on the basis of a length of time which is estimated to be needed for convergence of the amount of time variation of the internal pressure of the fuel tank below the predetermined threshold after the sealing valve is opened.

In the evaporated-fuel processing apparatus according to the seventh aspect of the present invention, the unnecessary process for calculating the time variation is dispensed with as much as possible. Therefore, the evaporated-fuel processing apparatus according to the seventh aspect of the present invention has an advantage of further contribution to energy saving, in addition to the advantages of the fifth aspect of the present invention.

The evaporated-fuel processing apparatus according to the eighth aspect of the present invention has the following additional feature as well as the features of the first aspect of the present invention. The additional feature of the evaporated-fuel processing apparatus according to the eighth aspect of the present invention is that the evaporated-fuel processing apparatus further includes a tank-internal-pressure detection unit which detects internal pressure of the fuel tank and an open/closed-state detection unit which detects an open/closed state of the open/close member, and the control unit issues the opening command when the refueling-intention-information acquisition unit acquires the information indicating an intention of refueling, allows the open/close member to open when the internal pressure of the fuel tank converges in a predetermined pressure range, and maintains the sealing valve in an open state when the open/closed-state detection unit detects that the open/closed state of the open/close member transitions from an open state to a closed state.

In the evaporated-fuel processing apparatus according to the eighth aspect of the present invention, even when the operator touches an open/closed-state detection unit by mistake during refueling, the sealing valve is maintained in the open state, i.e., the sealing valve 41 is not closed by mistake. As a result, refueling with prevention of air pollution can be performed smoothly and appropriately, compared with the configuration without the feature according to the eighth aspect of the present invention.

The evaporated-fuel processing apparatus according to the ninth aspect of the present invention has the following additional feature as well as the features of the eighth aspect of the present invention. The additional feature of the evaporated-fuel processing apparatus according to the ninth aspect of the present invention is that the evaporated-fuel processing apparatus further includes a running-state-information acquisition unit which acquires information on a running state of the vehicle, and the control unit issues a command to close the sealing valve when the running-state-information acquisition unit acquires information indicating that the vehicle starts running.

In the evaporated-fuel processing apparatus according to the ninth aspect of the present invention, the event in which the vehicle starts running triggers closing of the sealing valve. Therefore, it is possible to appropriately set and control the close timing of the sealing valve. In addition, the evaporated-fuel processing apparatus according to the ninth aspect of the present invention also has the advantages of the evaporated-fuel processing apparatus according to the eighth aspect of the present invention.

The evaporated-fuel processing apparatus according to the tenth aspect of the present invention has the following additional feature as well as the features of the eighth aspect of the present invention. The additional feature of the evaporated-fuel processing apparatus according to the tenth aspect of the present invention is that the evaporated-fuel processing apparatus further includes a running-state-information acquisition unit which acquires information on a running state of the vehicle, and the control unit issues a command to close the sealing valve when the time elapsed from a moment at which the refueling-intention-information acquisition unit acquires the information indicating an intention of refueling exceeds a second predetermined time.

In the evaporated-fuel processing apparatus according to the tenth aspect of the present invention, the event in which the time elapsed from the moment of acquisition of the information indicating presence of an intention of refueling exceeds the second predetermined time triggers closing of the sealing valve. Therefore, it is possible to appropriately set and control the close timing of the sealing valve. In addition, the evaporated-fuel processing apparatus according to the tenth aspect of the present invention also has the advantages of the evaporated-fuel processing apparatus according to the eighth aspect of the present invention.

The evaporated-fuel processing apparatus according to the eleventh aspect of the present invention has the following additional feature as well as the features of the eighth aspect of the present invention. The additional feature of the evaporated-fuel processing apparatus according to the eleventh aspect of the present invention is that the evaporated-fuel processing apparatus further includes an informing unit which provides an operator with information about refueling, and the control unit causes the informing unit to provide the operator with information indicating that refueling is allowed, in a period from a moment at which the open/close member is allowed to open until a moment at which the open/closed-state detection unit detects a transition of the open/close state of the open/close member from the open state to the closed state.

In the evaporated-fuel processing apparatus according to the eleventh aspect of the present invention, the information indicating allowance of refueling is provided to the driver or the operator in the period from the moment of opening to the moment of closing of the open/close member. Therefore, it is possible to improve the convenience in refueling. In addition, the evaporated-fuel processing apparatus according to the eleventh aspect of the present invention also has the advantages of the evaporated-fuel processing apparatus according to the eighth aspect of the present invention.

The evaporated-fuel processing apparatus according to the twelfth aspect of the present invention has the following additional feature as well as the features of the ninth aspect of the present invention. The additional feature of the evaporated-fuel processing apparatus according to the twelfth aspect of the present invention is that the evaporated-fuel processing apparatus further includes an informing unit which provides an operator with information about refueling, and the control unit causes the informing unit to provide the operator with alarm information indicating that the open/close member is in the open state, in a period from a moment at which the control unit issues the command to close the sealing valve until a moment at which the open/closed-state detection unit detects a transition of the open/close state of the open/close member from the open state to the closed state.

In the evaporated-fuel processing apparatus according to the twelfth aspect of the present invention, the alarm information indicating that the open/close member (fuel lid) is in the open state is provided to the driver or the operator, in the period from the moment at which the sealing valve is closed until the moment at which the open/closed-state-information acquisition unit acquires information indicating that the open/close member transitions from the open state to the closed state. Therefore, it is possible to appropriately prevent the operator from forgetting to close the open/close member. In addition, the evaporated-fuel processing apparatus according to the twelfth aspect of the present invention also has the advantages of the evaporated-fuel processing apparatus according to the ninth aspect of the present invention.

Advantageous Effect of Invention

According to the evaporated-fuel processing apparatus according to the present invention, it is possible to perform refueling so as to prevent air pollution.

BRIEF DESCRIPTION OF THE DRAWINGS

FIG. 5 is a timing diagram indicating a timing at which convergence is determined based on the level of the tank internal pressure in contrast with a timing at which convergence is determined based on time variations of the tank internal pressure with.

DETAILED DESCRIPTION OF THE INVENTION

Figure 1:
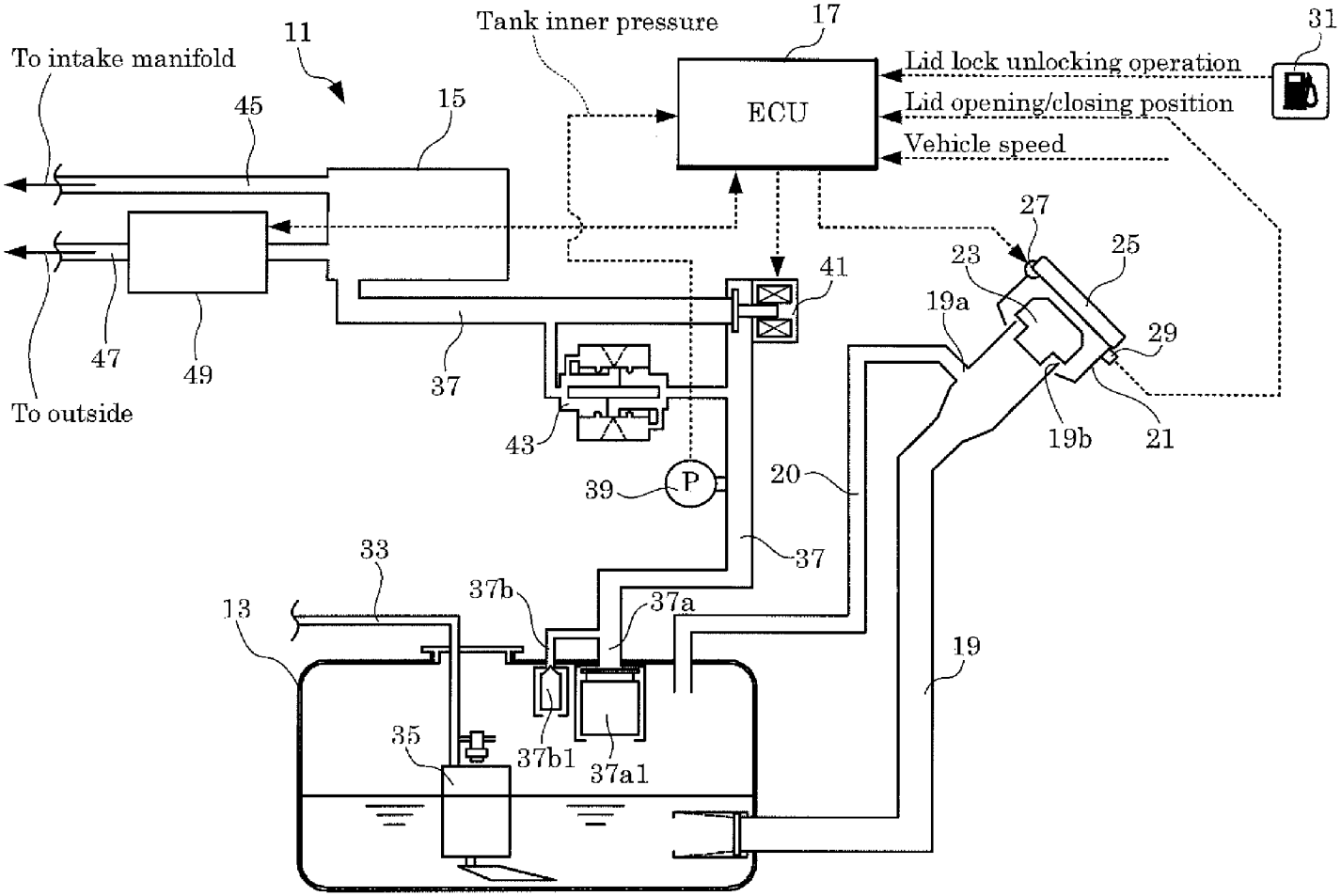
FIG. 1 is a diagram briefly illustrating the entire configuration of an evaporated-fuel processing apparatus according to an embodiment of the present invention.

Hereinbelow, the evaporated-fuel processing apparatus 11 according to embodiments of the present invention is explained in detail with reference to the accompanying drawings.

Outline of Evaporated-Fuel Processing Apparatus 11

First, an outline of the evaporated-fuel processing apparatus 11 according to an embodiment of the present invention is explained with reference to the accompanying drawings by taking an example in which the evaporated-fuel processing apparatus 11 is used in a hybrid vehicle having an internal combustion engine and one or more electric motors as driving power sources (although none of the internal combustion engine and the electric motors is shown). In the drawings, identical or equivalent elements bear an identical reference number, and the same explanations are not repeated. In addition, the elements are schematically illustrated, where the dimensions of the elements may be exaggerated, and the shapes of the elements may be deformed.

Figure 2:
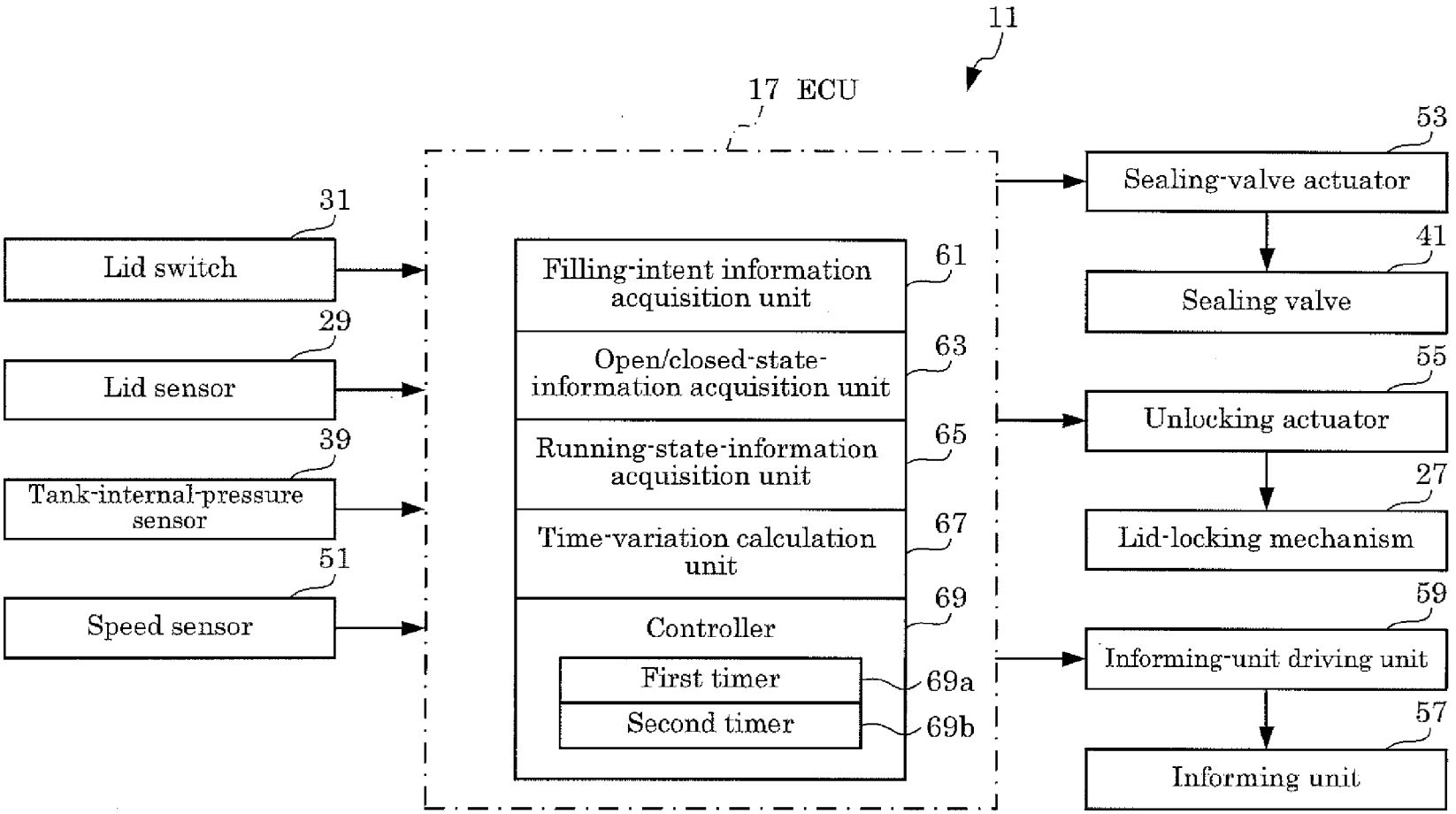
FIG. 2 is a function block diagram briefly illustrating the functions of the evaporated-fuel processing apparatus according to the embodiment of the present invention.

FIG. 1 is a diagram briefly illustrating the entire configuration of the evaporated-fuel processing apparatus 11 according to the embodiment of the present invention, and FIG. 2 is a function block diagram briefly illustrating the functions of the evaporated-fuel processing apparatus 11. The evaporated-fuel processing apparatus 11 processes evaporated fuel. As illustrated in FIG. 1, the evaporated-fuel processing apparatus 11 includes a canister 15, an ECU (electronic control unit) 17, and other elements. The canister 15 has a function of absorbing the evaporated fuel generated in a fuel tank 13, and the ECU 17 performs centralized control of the evaporated-fuel processing apparatus 11.

A fuel inlet pipe 19 is arranged in the fuel tank 13 as illustrated in FIG. 1. The fuel tank 13 reserves fuel such as gasoline. A circulation pipe 20 is arranged on the fuel inlet pipe 19. The circulation pipe 20 communicably connects an upstream portion 19*a* of the fuel inlet pipe 19 and the fuel tank 13, so that the fuel inlet pipe 19 and the fuel tank 13 communicate with each other. A fuel filling port 19*b* is arranged at an end of the fuel inlet pipe 19 opposite to the fuel tank 13. A nozzle of a fuel gun (not shown) is to be inserted into the fuel filling port 19*b*. The fuel filling port 19*b* is enclosed in a fuel inlet box 21, which is arranged in a rear fender (not shown) of the vehicle body to have a concave shape. A screw-type filler cap 23 is attached to the fuel filling port 19*b*.

A fuel lid 25 covering the filler cap 23 is attached to the fuel inlet box 21 in such a manner that the fuel lid 25 can be freely closed or opened. The filler cap 23 and the fuel lid 25 correspond to the aforementioned "open/close member" according to the present invention. A lid-locking mechanism 27 for regulating opening of the fuel lid 25 is arranged in the fuel lid 25. In order to remotely release locking of the lid-locking mechanism 27 during refueling, a lid switch 31, which is to be manipulated by the operator, is arranged in the car interior.

A lid sensor 29, which detects the open/closed state of the fuel lid 25, is arranged in the fuel lid 25. The lid sensor 29 corresponds to the aforementioned "open/closed-state detection unit" according to the present invention. Information on the open/closed state of the fuel lid 25, which is detected by the lid sensor 29, is sent to the ECU 17.

During normal operation other than the refueling time, the fuel lid 25 is locked by the lid-locking mechanism 27, and maintained in the closed state. On the other hand, during refueling, the lid switch 31 is manipulated, and the ECU 17 unlocks the lid-locking mechanism 27 when a predetermined condition (which is explained later) is satisfied. Therefore, the fuel lid 25 is opened. Then, the operator removes the filler cap 23, which becomes accessible because the fuel lid 25 is opened. Thus, the operator can refill the fuel by inserting the nozzle of the fuel gun into the fuel filling port 19*b*.

A fuel pump module 35 is arranged in the fuel tank 13. The fuel pump module 35 pumps up the fuel reserved in the fuel tank 13, and sends the pumped-up fuel through a fuel supply path 33 to injectors (not shown). In addition, an evaporated-fuel discharge path 37, which communicably connects the fuel tank 13 and the canister 15, is arranged in the fuel tank 13. The evaporated-fuel discharge path 37 has a function of a flow path for the evaporated fuel.

The fuel tank 13 side of the evaporated-fuel discharge path 37 is split into two branch paths. A float valve 37*a*1 is arranged in one 37*a* of the two branch paths of the evaporated-fuel discharge path 37, and a cut valve 37*b*1 is arranged in the other 37*b* of the two branch paths.

The float valve 37*a*1 operates to close when tank internal pressure Ptank (which is the pressure of the vapor-phase region in the fuel tank 13) is raised by rise of the liquid level of the fuel which is accompanied by refueling. Specifically, the float valve 37*a*1 prevents the fuel from entering the evaporated-fuel discharge path 37 from the fuel tank 13, by closing the float valve 37*a*1 when the fuel tank 13 is filled up with the fuel.

On the other hand, the cut valve 37*b*1 operates to close when the vehicle is tilted to more than a predetermined angle. Specifically, the cut valve 37*b*1 is open when the fuel tank 13 is full, and closed when the vehicle is tilted to more than the predetermined angle, so that it is possible to prevent the fuel from entering the evaporated-fuel discharge path 37 from the fuel tank 13.

A tank-internal-pressure sensor 39, a sealing valve 41, and a high-pressure two-way valve 43 are arranged in the evaporated-fuel discharge path 37. The tank-internal-pressure sensor 39 corresponds to the aforementioned "tank-internal-pressure detection unit".

The tank-internal-pressure sensor 39 has a function of detecting the tank internal pressure Ptank, which is the pressure of the vapor-phase region in the fuel tank 13. Alternatively, the tank-internal-pressure sensor 39 may be arranged directly in the fuel tank 13. Preferably, a piezoelectric element can be used as a pressure detector in the tank-internal-pressure sensor 39. Information on the tank internal pressure Ptank detected by the tank-internal-pressure sensor 39 is sent to the ECU 17.

The sealing valve 41 has a function of shutting the internal space of the fuel tank 13 off from the atmosphere. Specifically, the sealing valve 41 is a normally closed type solenoid valve which operates in accordance with an open/close control signal sent from the ECU 17. That is, the sealing valve 41 shuts the internal space of the fuel tank 13 off from the atmosphere or bringing the internal space of the fuel tank 13 into communication with the atmosphere in accordance with the open/close control signal sent from the ECU 17.

The high-pressure two-way valve 43 has a function of controlling the flow direction of the evaporated fuel on the basis of the pressure difference between the fuel tank 13 side and the canister 15 side. Specifically, the high-pressure two-way valve 43 is a mechanical valve in which diaphragm type positive and negative-pressure valves are combined. The high-pressure two-way valve 43 is arranged parallel to the sealing valve 41 in the evaporated-fuel discharge path 37.

The positive-pressure valve in the high-pressure two-way valve 43 operates to open when the pressure on the fuel tank 13 side becomes a predetermined amount higher than the pressure on the canister 15 side. When the positive-pressure valve in the high-pressure two-way valve 43 is open, the evaporated fuel the pressure of which becomes high in the fuel tank 13 is sent to the canister 15 side through the positive-pressure valve in the high-pressure two-way valve 43.

On the other hand, the negative-pressure valve in the high-pressure two-way valve 43 operates to open when the pressure on the fuel tank 13 side becomes a predetermined amount lower then the pressure on the canister 15 side. When the negative-pressure valve in the high-pressure two-way valve 43 is open, the evaporated fuel reserved in the canister 15 is returned back to the fuel tank 13 side through the negative-pressure valve in the high-pressure two-way valve 43.

The canister 15 contains adsorbent (not shown) constituted by activated carbon for absorbing the evaporated fuel. The adsorbent in the canister 15 absorbs the evaporated fuel sent from the fuel tank 13 side through the evaporated-fuel discharge path 37. The canister 15 is communicably connected to each of a purge path 45 and an atmosphere introducing path 47 in addition to the evaporated-fuel discharge path 37.

The side of the purge path 45 opposite to the canister 15 is communicably connected to an intake manifold (not shown). On the other hand, the side of the atmosphere introducing path 47 opposite to the canister 15 is communicably connected to the atmosphere. A diagnostic module 49 is arranged in the atmosphere introducing path 47. Although not shown, the diagnostic module 49 contains a negative-pressure pump, a pressure sensor, a reference orifice, and a switch valve which opens or closes the atmosphere introducing path 47. The diagnostic module 49 is used when leakage of the evaporated fuel in the fuel tank 13, the canister 15, and the evaporated-fuel discharge path 37 and the function of the sealing valve 41 are diagnosed.

The canister 15 operates to perform purging, in which air taken in through the atmosphere introducing path 47, together with the evaporated fuel absorbed by the absorbent in the canister 15, is sent to the intake manifold through the purge path 45.

The lid switch 31, the lid sensor 29, the tank-internal-pressure sensor 39, and a speed sensor 51 are connected as inputs to the ECU 17 as illustrated in FIG. 2. The speed sensor 51 has a function of detecting the speed of the vehicle (not shown) on which the evaporated-fuel processing apparatus 11 is mounted. Information on the speed of the vehicle detected by the speed sensor 51 is sent to the ECU 17.

In addition, a sealing-valve actuator 53, an unlocking actuator 55, and an informing-unit driving unit 59 are connected as outputs to the ECU 17 as illustrated in FIG. 2. The sealing-valve actuator 53 actuates the sealing valve 41, the unlocking actuator 55 actuates the lid-locking mechanism 27, and the informing-unit driving unit 59 drives an informing unit 57. The informing unit 57 has a function of providing the driver or the operator with information about refueling. Specifically, it is possible to preferably use as the informing unit 57 a display unit (not shown) and a voice output unit which are arranged in the car interior. For example, the display unit may be a liquid crystal display, and the voice output unit may be a speaker.

The ECU 17 contains a refueling-intention-information acquisition unit 61, an open/closed-state-information acquisition unit 63, a running-state-information acquisition unit 65, a time-variation calculation unit 67, and a controller 69 as illustrated in FIG. 2.

the ECU 17 is constituted by a microcomputer which contains a CPU (Central Processing Unit), an ROM (Read Only Memory), an RAM (Random Access Memory), and executes the program such that the ECU 17 operates to control and perform various functions which the ECU 17 has. The functions of the ECU 17 include the function of acquiring information on an intention of refueling, the function of acquiring information on the open/closed state, the function of acquiring information on the running state, and the function of calculating variations with time, and the function of centralized control of the entire evaporated-fuel processing apparatus 11. The ECU 17 corresponds to the aforementioned "control unit" according to the present invention.

The refueling-intention-information acquisition unit 61 has a function of acquiring information indicating an intention of refueling. Specifically, the refueling-intention-information acquisition unit 61 acquires as the information indicating an intention of refueling a request to unlock the lid-locking mechanism 27 which is made by a manipulation of the lid switch 31, because the request to unlock the lid-locking mechanism 27 is basically made only when the operator has an intention of refueling.

The open/closed-state-information acquisition unit 63 has a function of acquiring information on the open/closed state of the fuel lid 25. Specifically, the open/closed-state-information acquisition unit 63 acquires as the information on the open/closed state a result of detection by the lid sensor 29.

The running-state-information acquisition unit 65 has a function of acquiring information on the running state of the vehicle. Specifically, the running-state-information acquisition unit 65 acquires as the information on the running state of the vehicle information indicating the speed of the vehicle detected by the speed sensor 51.

The time-variation calculation unit 67 has a function of calculating the time variation Pdt of the tank internal pressure based on the level of the tank internal pressure Ptank, which is detected by the tank-internal-pressure sensor 39 and varies with time. At this time, the time variation Pdt of the tank internal pressure means the dispersion (scattering) of the tank internal pressure Ptank per unit time, and the unit time is a length of time which is preset and can be changed when necessary. In addition, the time variation Pdt of the tank internal pressure includes a moving average of three or more values of the tank internal pressure Ptank at consecutive times.

The time variation Pdt of the tank internal pressure calculated with the time-variation calculation unit 67 is referred to when a determination is made as to whether or not the tank internal pressure Ptank converges in a predetermined pressure range, which is set, for example, to include an appropriate tolerance on both sides of the atmospheric pressure.

The controller 69 contains first and second timers 69*a* and 69*b* (as illustrated in FIG. 2) for counting the elapsed time from an arbitrary time. The controller 69 has a function of issuing an opening command for opening the sealing valve 41 when the refueling-intention-information acquisition unit 61 acquires the information indicating presence of an intention of refueling, and allowing the fuel lid 25 to open when a first elapsed time PT1, which is the elapsed time from the moment of the issue of the opening command, exceeds a first predetermined time PTth1. (The first elapsed time PT1 is accumulated by the first timer 69*a*.)

The first predetermined time PTth1 is set on the basis of the time estimated to be needed for the tank internal pressure Ptank to converge into the aforementioned predetermined pressure range after the opening of the sealing valve 41. Alternatively, the first predetermined time PTth1 may be set on the basis of the time estimated to be needed for the sealing valve 41 to actually open after the issue of the opening command.

In addition, the phrase "allowing the fuel lid 25 to open" means unlocking the lid-locking mechanism 27. This is because when the lid-locking mechanism 27 is unlocked, the fuel lid 25 is released from the restraint by the lid-locking mechanism 27, so that the fuel lid 25 is allowed to open.

Further, the controller 69 has a function of maintaining the open state of the sealing valve 41 when the controller 69 acquires from the open/closed-state-information acquisition unit 63 information indicating that the fuel lid 25 transitions from the open state to the closed state, i.e., when it is highly probable that refueling is completed.

Furthermore, the controller 69 has a function of issuing a command to close the sealing valve 41 when the controller 69 acquires from the running-state-information acquisition unit 65 information indicating that the vehicle on which the evaporated-fuel processing apparatus 11 is mounted starts running, i.e., when it is highly probable that refueling is completed.

Moreover, the controller 69 has a function of issuing a command to close the sealing valve 41 when a second elapsed time PT2, which is the elapsed time since the refueling-intention-information acquisition unit 61 acquires the information indicating presence of an intention of refueling, exceeds a second predetermined time PTth2, i.e., when it is highly probable that refueling is completed. (The second elapsed time PT2 is accumulated by the second timer 69*b*.) The second elapsed time PT2 is a length of time which is appropriately set such that the second elapsed time PT2 exceeds the time needed for the refueling. For example, the second elapsed time PT2 is set to 30 minutes.

In addition, the controller 69 has a function of causing the informing unit 57 to provide the driver or the operator with information indicating allowance of refueling in the period from the moment at which the fuel lid 25 is allowed to open until the moment at which the lid sensor 29 detects a transition of the fuel lid 25 from the open state to the closed state.

Furthermore, the controller 69 has a function of causing the informing unit 57 to provide the driver or the operator with alarm information, in the period from the moment at which a command to close the sealing valve 41 is issued until the moment at which the lid sensor 29 detects a transition of the fuel lid 25 from the open state to the closed state, where the alarm information indicates that the fuel lid 25 is in the open state.

Operations of Evaporated-Fuel Processing Apparatus 11

Next, operations of the evaporated-fuel processing apparatus 11 according to the embodiment of the present invention are explained with reference to FIG. 3, which is a flow diagram indicating a flow of operations for open/close control of the sealing valve 41 during refueling, where the operations are performed by the evaporated-fuel processing apparatus 11 according to the embodiment of the present invention.

Figure 3:
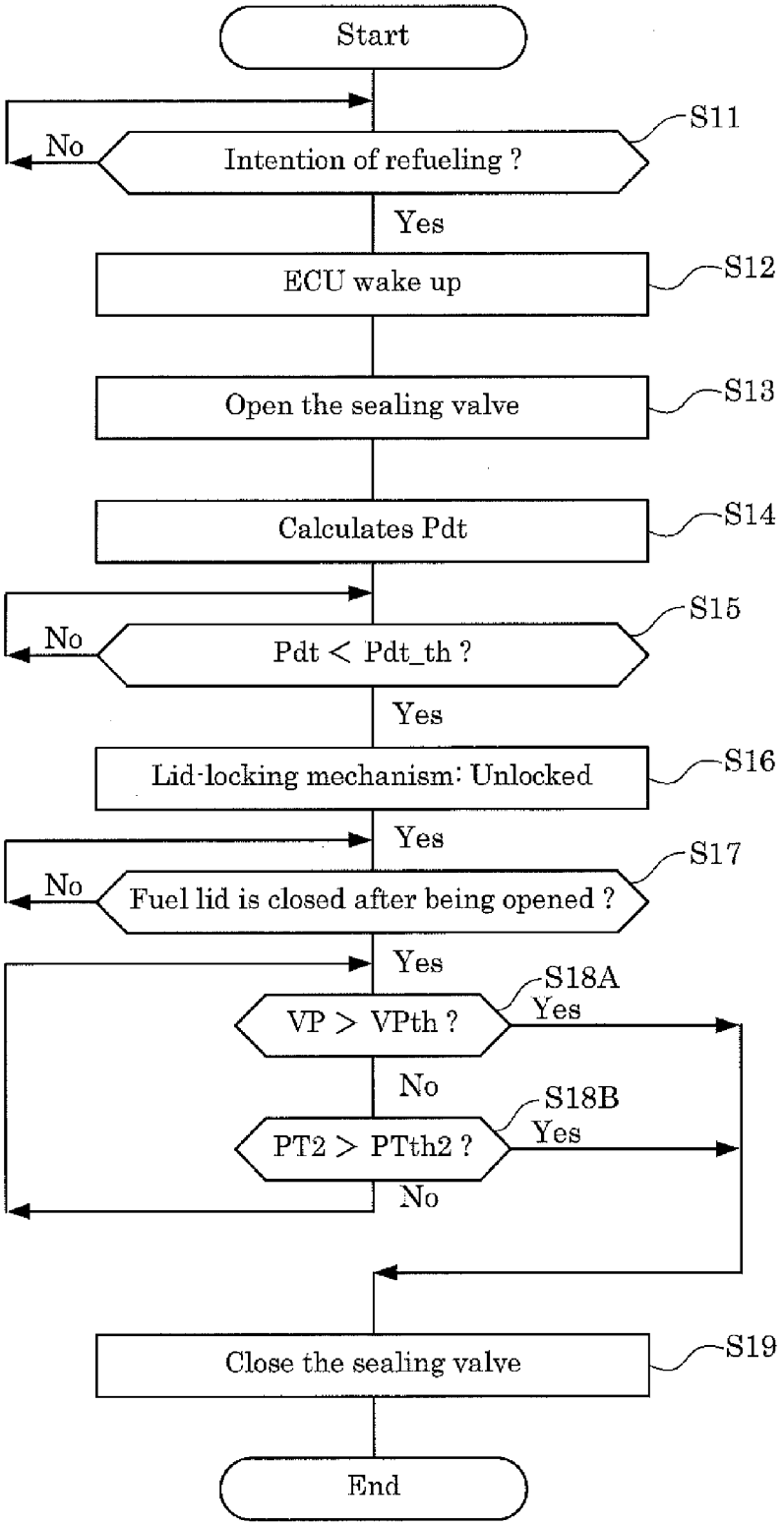
FIG. 3 is a flow diagram indicating a flow of operations for open/close control of a sealing valve during refueling, where the operations are performed by the evaporated-fuel processing apparatus according to the embodiment of the present invention.

In the example indicated in FIG. 3, it is assumed that the operation mode of the ECU 17 is initially a sleep mode, in which the operation is limited to the monitoring for the on state of the lid switch 31 for power saving.

In step S11 in FIG. 3, the ECU 17 determines presence or absence of an intention of refueling on the basis of fueling-intention information which is acquired by the refueling-intention-information acquisition unit 61. The ECU 17 repeats the operation of determination in step S11 until presence of an intention of refueling is determined. When presence of an intention of refueling is determined in step S11 (i.e., when "Yes" is determined in step S11), the ECU 17 advances the operation to the next step S12.

In step S12, the ECU 17 is triggered by the determination of the presence of an intention of refueling in step 11 and wakes up, so that the ECU 17 transitions from the sleep mode to a normal mode, in which various functions of the ECU 17 can be performed.

In step S13, the controller 69 issues a command to open the sealing valve 41. In response to the command, the sealing-valve actuator 53 actuates the sealing valve 41 to open.

In step S14, the time-variation calculation unit 67 calculates the time variation Pdt of the tank internal pressure on the basis of the tank internal pressure Ptank, which is detected by the tank-internal-pressure sensor 39 and varies with time.

In step S15, the controller 69 determines whether or not the time variation Pdt of the tank internal pressure calculated in step S14 converges below a predetermined variation threshold Pdt_th.

Generally, in many cases under the normal condition other than the refueling time (in which the sealing valve 41 is closed), the tank internal pressure Ptank in the fuel tank 13, which is sealed, is higher than the atmospheric pressure. This is because when the ambient temperature of the fuel tank 13 rises, the fuel (e.g., gasoline) in the fuel tank 13 evaporates and the pressure of the vapor-phase region in the fuel tank 13 rises.

If the fuel tank 13 is refilled under a condition in which the tank internal pressure Ptank in the fuel tank 13 is higher than the atmospheric pressure, the evaporated fuel in the fuel tank 13 can be emitted to the atmosphere through the fuel inlet pipe 19. That is, it is undesirable to refill the fuel tank 13 under the above condition. Therefore, in step 15, a determination whether or not refueling can be performed so as to prevent air pollution is made by determining whether or not the time variation Pdt of the tank internal pressure Ptank converges below the predetermined variation threshold Pdt_th.

The controller 69 repeats the determination in step 15 until the time variation Pdt of the tank internal pressure Ptank is determined to converge below the predetermined variation threshold Pdt_th. When it is determined in step 15 that the time variation Pdt of the tank internal pressure Ptank converges below the predetermined variation threshold Pdt_th (i.e., when "Yes" is determined in step S15), the ECU 17 advances the operation to step the next step S16.

In step S16, the controller 69 issues a command to unlock the lid-locking mechanism 27. In response to the command, the unlocking actuator 55 unlocks the lid-locking mechanism 27.

In step S17, the ECU 17 determines whether or not the fuel lid 25 is closed after being opened, on the basis of the information on the open/closed state of the fuel lid 25, which is acquired by the open/closed-state-information acquisition unit 63. The ECU 17 repeats the determination in step 17 until the fuel lid 25 is determined to be closed after being opened. When it is determined in step 17 that the fuel lid 25 is closed after being opened (i.e., when "Yes" is determined in step S17), the ECU 17 advances the operation to the next step S18A.

In step S18A, the ECU 17 determines whether or not running of the vehicle on which the evaporated-fuel processing apparatus 11 is mounted is started. Specifically, the ECU 17 determines whether or not the speed VP of the vehicle exceeds a vehicle-speed threshold VPth.

When it is determined in step S18A that running of the vehicle is not started (i.e., when "No" is determined in step S18A), the ECU 17 advances the operation to the next step S18B.

In step S18B, the controller 69 determines whether or not the second elapsed time PT2 exceeds the second predetermined time PTth2, on the basis of information on the second elapsed time PT2, which is accumulated since the refueling-intention-information acquisition unit 61 acquires the information indicating presence of an intention of refueling.

When it is determined in step S18B that the second elapsed time PT2 does not exceed the second predetermined time PTth2 (i.e., when "No" is determined in step S18B), the ECU 17 returns the operation back to step S18A, and repeats the determination in steps 18A and 18B until "Yes" is determined in either of steps 18A and 18B. When "Yes" is determined in either of steps 18A and 18B, the ECU 17 advances the operation to the next step S19.

In step S19, the controller 69 issues a command to close the sealing valve 41. In response to the command, the sealing-valve actuator 53 actuates the sealing valve 41 to close. Thereafter, the ECU 17 completes the flow of the operations for open/close control of the sealing valve 41 during refueling in FIG. 3.

Timing Sequence of Evaporated-Fuel Processing Apparatus 11

Figure 4A:
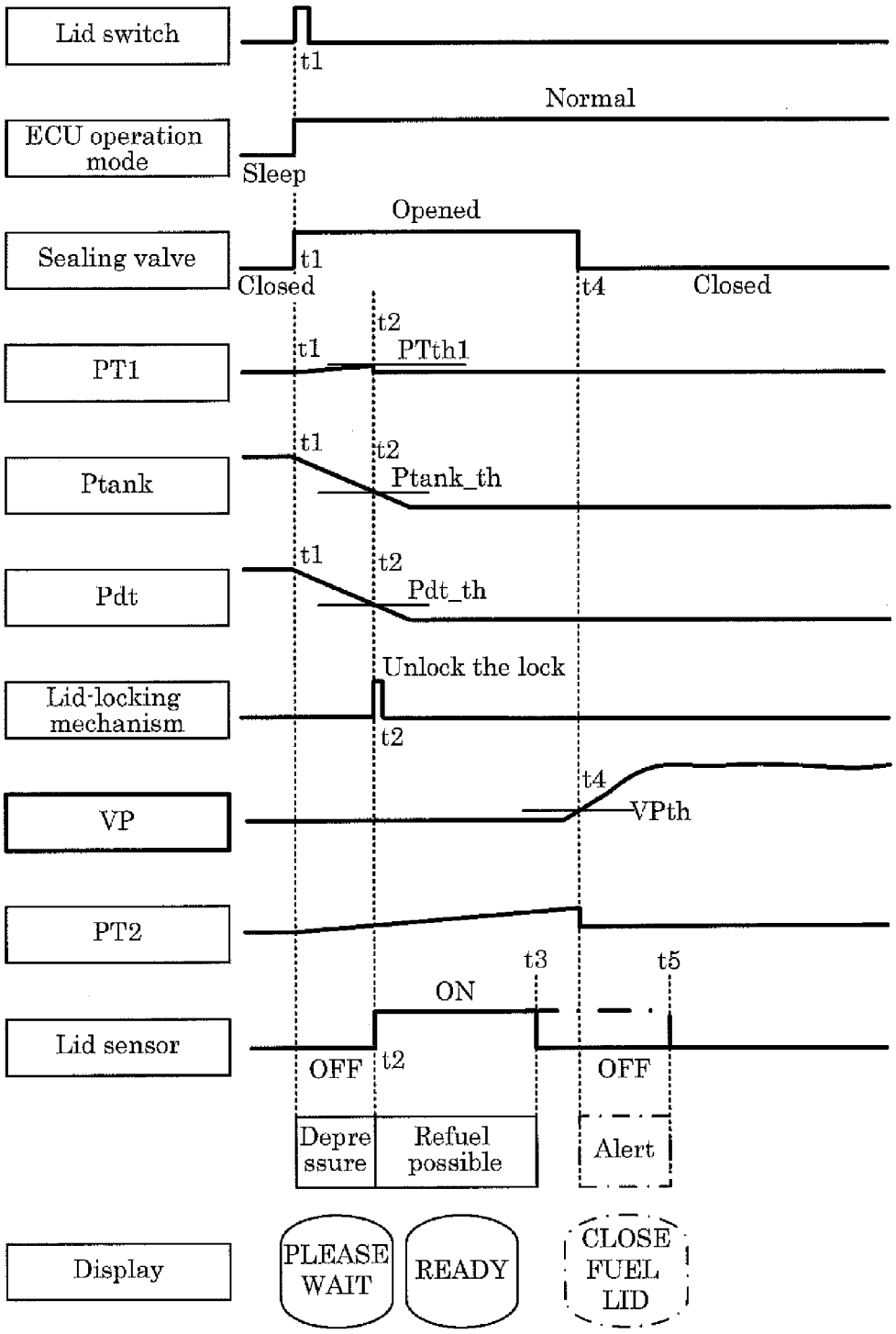
FIG. 4A is a timing diagram presented for explaining operations for closing the sealing valve which are triggered by an event of a start of running of a vehicle on which the operations are performed.
Figure 4B:
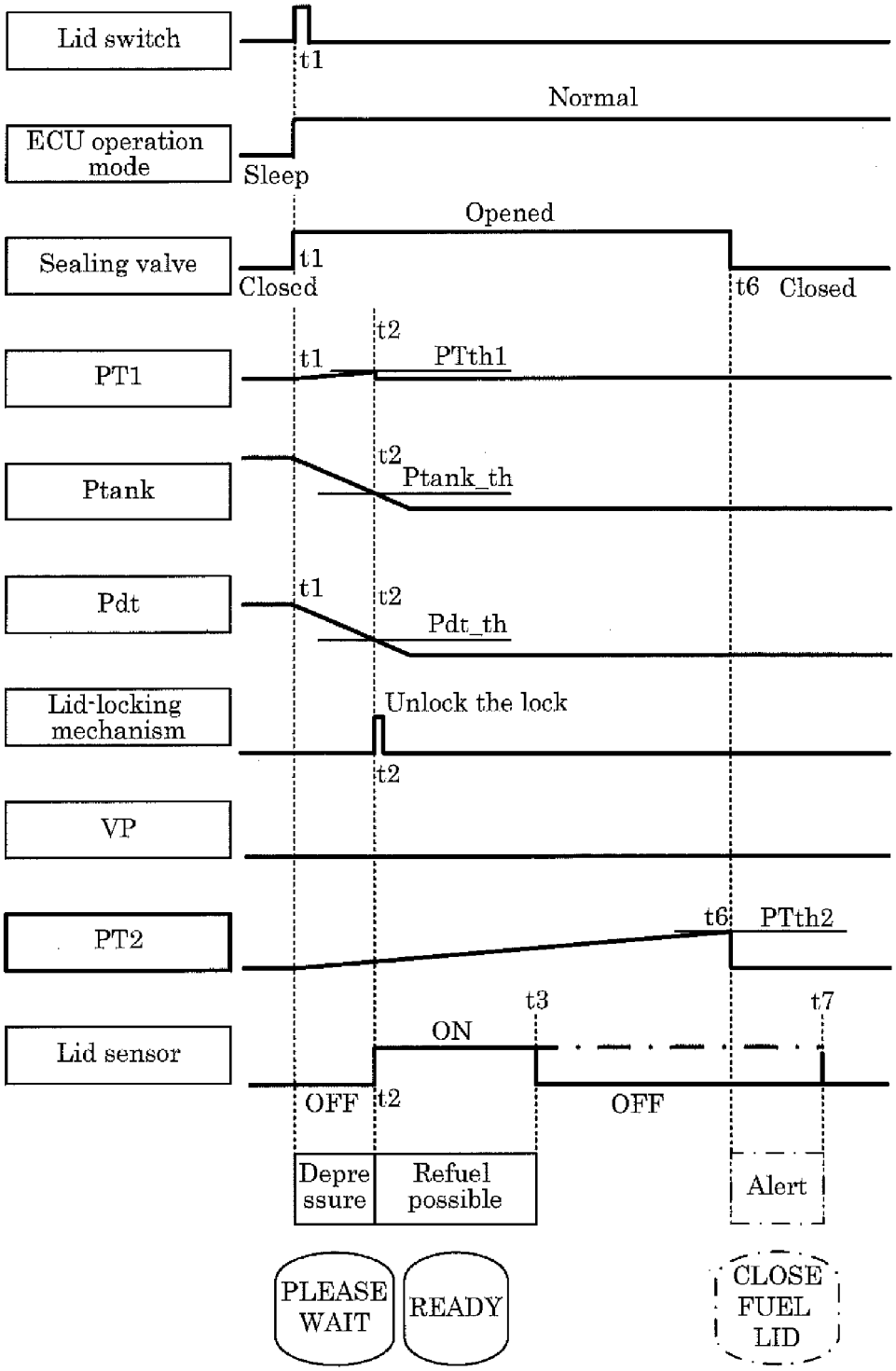
FIG. 4B is a timing diagram presented for explaining operations for closing the sealing valve which are triggered by an event of excess of a second elapsed time over a second predetermined time, where the second elapsed time is a time elapsed from the moment at which a filling-intent information acquisition unit acquires information indicating that fuel filling is intended.

Next, the timing sequences of the operations in the evaporated-fuel processing apparatus 11 according to the embodiment of the present invention are explained in detail below with reference to FIGS. 4A and 4B. FIG. 4A is a timing diagram presented for explaining operations for closing the sealing valve 41 which are triggered by an event of a start of running of the vehicle on which the operations are performed, and FIG. 4B is a timing diagram presented for explaining operations for closing the sealing valve 41 which are triggered by an event of excess of the second elapsed time PT2 over the second predetermined time PT2th, where the second elapsed time PT2 is the time elapsed from the moment at which the filling-intent information acquisition unit 61 acquires information indicating that fuel filling is intended.

Before explaining the timing sequences of the operations in the evaporated-fuel processing apparatus 11, an outline of the present invention and problems in an evaporated-fuel processing technique as a conventional example for comparison are referred to. In the configuration according to the evaporated-fuel processing technique as the conventional example, unlocking of the fuel lid 25 is triggered by an event in which the detected value of the tank internal pressure Ptank comes to satisfy a predetermined convergence-determination condition (i.e., comes to a vicinity of the atmospheric pressure). Therefore, if a failure in which the output value of the tank-internal-pressure sensor 39 is stuck to a vicinity of the atmosphere occurs, even when the tank internal pressure is actually high, the sensor outputs a wrong value indicating the tank internal pressure is in the vicinity of the atmosphere, so that erroneous unlocking of the fuel lid can occur. As a result, it is impossible to perform refueling so as to prevent air pollution.

Thus, in the configuration of the evaporated-fuel processing apparatus 11 according to the embodiment of the present invention, unlocking of the fuel lid 25 is triggered by the event in which the first elapsed time PT1, as the elapsed time from the time of the issue of the opening command for the sealing valve 41, exceeds the first predetermined time PTth1, instead of being triggered by the event in which the detected value of the tank internal pressure Ptank comes to satisfy the predetermined convergence-determination condition (i.e., comes to a vicinity of the atmospheric pressure).

In addition, in the evaporated-fuel processing technique as the conventional example, closing of the sealing valve 41 is triggered by the event in which the fuel lid 25 is closed. Therefore, if the operator touches an open/closed-state detecting part in the lid sensor 29 by mistake during refueling, the fuel lid 25 may erroneously detect that the fuel lid 25 is closed, so that the sealing valve 41 can be closed by mistake. If the refueling is continued in such a situation, the evaporated fuel will be emitted to the atmosphere. As a result, it is impossible to perform refueling so as to prevent air pollution.

Thus, in the configuration of the evaporated-fuel processing apparatus 11 according to the embodiment of the present invention, closing of the sealing valve 41 is not triggered by the event in which the fuel lid 25 is closed. Instead, the open state of the sealing valve 41 is maintained at the moment at which the fuel lid 25 is closed (at the time t3 in FIG. 4B), and closing of the sealing valve 41 is triggered by the event in which the vehicle starts running (at the time t4 in FIG. 4A) or the event in which the second elapsed time PT2 exceeds the second predetermined time PT2th (at the time t6 in FIG. 4B), where the second elapsed time PT2 is the time elapsed from the moment at which the filling-intent information acquisition unit 61 acquires information indicating presence of an intention of refueling (at the time t1 in FIG. 4B).

The operations of the evaporated-fuel processing apparatus 11 having the configuration in which closing of the sealing valve 41 is triggered by the start of running of the vehicle are explained in further detail below with reference to FIG. 4A. Referring to FIG. 4A, when the lid switch 31 is manipulated to be turned on (as indicated in FIG. 4A), the operational mode of the ECU 17 transitions from the sleep mode to the normal mode (as indicated in FIG. 4A), and the sealing valve 41 is opened (as indicated in FIG. 4A). The event in which the sealing valve 41 is opened triggers a gradual decrease of the tank internal pressure Ptank (as indicated in FIG. 4A).

When the first elapsed time PT1 from the moment (t1) at which an opening command for the sealing valve 41 is issued exceeds the first predetermined time PTth1 (as indicated in FIG. 4A) at the time t2, the lid-locking mechanism 27 is unlocked (as indicated in FIG. 4A), and the fuel lid 25 is opened. At this time, the output of the lid sensor 29 is turned on (as indicated in FIG. 4A). The ordinate in the item of "PT1" in FIG. 4A corresponds to the time elapsed from the time t1.

In addition, also when the tank internal pressure Ptank converges in a predetermined pressure range satisfying Ptank<Ptank_th (as indicated in FIG. 4A) at the time t2, the lid-locking mechanism 27 is unlocked (as indicated in FIG. 4A), the fuel lid 25 is opened, and the output of the lid sensor 29 is turned on (as indicated in FIG. 4A).

In this example, for convenience of explanation, it is assumed that the event in which the first elapsed time PT1 exceeds the first predetermined time PTth1 and the event in which the tank internal pressure Ptank converges in a predetermined pressure range satisfying Ptank<Ptank_th occur at the same time. However, the above events may occur at different times.

Further, also when the time variation Pdt of the tank internal pressure Ptank converges below the predetermined variation threshold Pdt_th at the time t2 (as indicated in FIG. 4A), the lid-locking mechanism 27 is unlocked (as indicated in FIG. 4A), the fuel lid 25 is opened, and the output of the lid sensor 29 is turned on (as indicated in FIG. 4A).

In the example of FIG. 4A, for convenience of explanation, it is assumed that the event in which the first elapsed time PT1 exceeds the first predetermined time PTth1 and the event in which the time variation Pdt of the tank internal pressure Ptank converges below the predetermined variation threshold Pdt_th occur at the same time. However, the above events may occur at different times.

Furthermore, In the example of FIG. 4A, for convenience of explanation, it is assumed that the event in which the tank internal pressure Ptank converges in a predetermined pressure range satisfying Ptank<Ptank_th and the event in which the time variation Pdt of the tank internal pressure Ptank converges below the predetermined variation threshold Pdt_th occur at the same time. However, the above events may occur at different times.

In summary, when at least one of the first event in which the first elapsed time PT1 exceeds the first predetermined time PTth1, the second event in which the tank internal pressure Ptank converges in a predetermined pressure range satisfying Ptank<Ptank_th, and the third event in which the time variation Pdt of the tank internal pressure Ptank converges below the predetermined variation threshold Pdt_th occurs, the at least one event triggers unlocking of the lid-locking mechanism 27 and the opening of the fuel lid 25.

In the period from t1 to t2, the informing unit (meter display unit) 57 displays "PLEASE WAIT" for requesting the operator to wait before starting refueling (as indicated in FIG. 4A).

When the operator performs a manipulation to close the fuel lid 25 (and the lid sensor 29 is turned off as indicated in FIG. 4A) at the time t3, the open state of the sealing valve 41 is maintained (as indicated in FIG. 4A).

In the period from t2 to t3, the informing unit (meter display unit) 57 displays "READY" indicating that refueling is allowed (as indicated in FIG. 4A).

When the vehicle on which the evaporated-fuel processing apparatus 11 is mounted starts running (and the vehicle speed VP exceeds the vehicle-speed threshold VPth as indicated in FIG. 4A) at the time t4, the sealing valve 41 is closed (as indicated in FIG. 4A).

If the operator performs a manipulation to close the fuel lid 25 (and the lid sensor 29 is turned off as indicated in FIG. 4A) at the time t5, the fuel lid 25 is in the open state until the time t5, so that the output of the lid sensor 29 is in the on state in the period from t3 to t5 (as indicated by the dot-dash line in the item of "Lid sensor" in FIG. 4A). In particular, since the lid sensor 29 is in the on state (and the fuel lid 25 is in the open state) in the period from t4 to t5, the informing unit (meter display unit) 57 displays "CLOSE FUEL LID" prompting the operator to close the fuel lid 25 (as indicated in FIG. 4A) in the period from t4 to t5.

Next, the operations of the evaporated-fuel processing apparatus 11 having the configuration in which closing of the sealing valve 41 is triggered by the event in which the second elapsed time PT2 (which is the time elapsed from the moment of acquisition of information indicating presence of an intention of refueling) exceeds the second predetermined time PTth2 are explained in further detail below with reference to FIG. 4B. Referring to FIG. 4B, when the lid switch 31 is manipulated to be turned on (as indicated in FIG. 4B), the ECU 17 acquires information indicating presence of an intention of refueling, and the operational mode of the ECU 17 transitions from the sleep mode to the normal mode (as indicated in FIG. 4B), and the sealing valve 41 is opened (as indicated in FIG. 4B). The event in which the sealing valve 41 is opened triggers a gradual decrease of the tank internal pressure Ptank (as indicated in FIG. 4B).

When the first elapsed time PT1 from the moment (t1) at which an opening command for the sealing valve 41 is issued exceeds the first predetermined time PTth1 (as indicated in FIG. 4B) at the time t2, the lid-locking mechanism 27 is unlocked (as indicated in FIG. 4B), and the fuel lid 25 is opened. At this time, the output of the lid sensor 29 is turned on (as indicated in FIG. 4B).

In addition, also when the tank internal pressure Ptank converges in a predetermined pressure range satisfying Ptank<Ptank_th (as indicated in FIG. 4B) at the time t2 (similarly to the example of FIG. 4A), the lid-locking mechanism 27 is unlocked (as indicated in FIG. 4B), the fuel lid 25 is opened, and the output of the lid sensor 29 is turned on (as indicated in FIG. 4B).

Further, also when the time variation Pdt of the tank internal pressure Ptank converges below the predetermined variation threshold Pdt_th at the time t2 (as indicated in FIG. 4B), the lid-locking mechanism 27 is unlocked (as indicated in FIG. 4B), the fuel lid 25 is opened, and the output of the lid sensor 29 is turned on (as indicated in FIG. 4B).

In the period from t1 to t2, the informing unit (meter display unit) 57 displays "PLEASE WAIT" for requesting the operator to wait before starting refueling (as indicated in FIG. 4B).

When the operator performs a manipulation to close the fuel lid 25 (and the lid sensor 29 is turned off as indicated in FIG. 4B) at the time t3, the open state of the sealing valve 41 is maintained (as indicated in FIG. 4B).

In the period from t2 to t3, the informing unit (meter display unit) 57 displays "READY" indicating that refueling is allowed (as indicated in FIG. 4B).

When the second elapsed time PT2 (which is the time elapsed from the moment of acquisition, by the refueling-intention-information acquisition unit 61, of information indicating presence of an intention of refueling) exceeds the second predetermined time PTth2 as indicated in FIG. 4B) at the time t6, the sealing valve 41 is closed (as indicated in FIG. 4B).

If the operator performs a manipulation to close the fuel lid 25 (and the lid sensor 29 is turned off as indicated in FIG. 4B) at the time t7, the fuel lid 25 is open until the time t7, so that the output of the lid sensor 29 is in the on state in the period from t3 to t7 (as indicated by the dot-dash line in the item of "Lid sensor" in FIG. 4B). Therefore, the informing unit (meter display unit) 57 displays "CLOSE FUEL LID" prompting the operator to close the fuel lid 25 (as indicated in FIG. 4B) in the period from t6 to t7.

Advantageous Effects of Evaporated-Fuel Processing Apparatus 11

Figure 5:
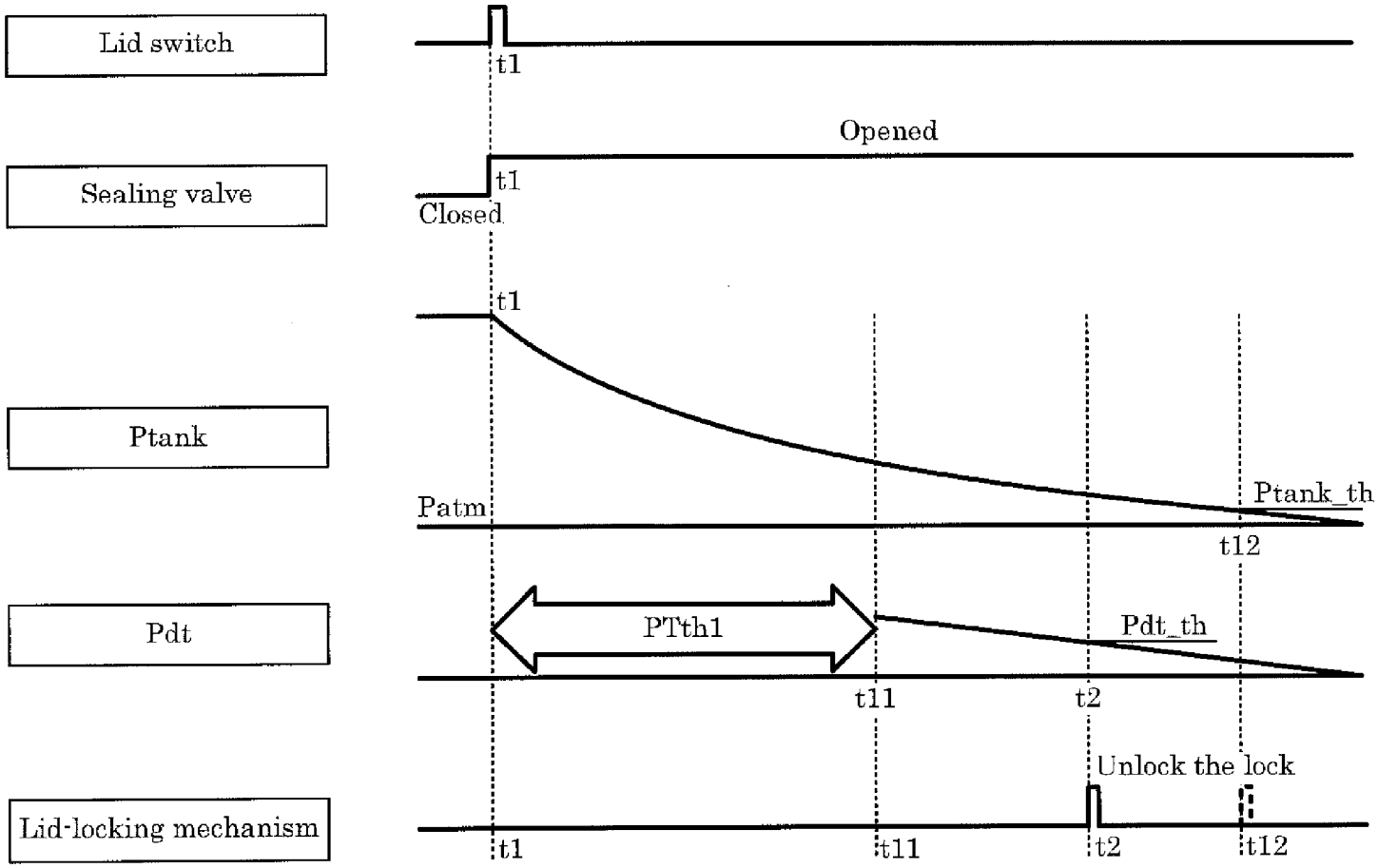

Next, the advantageous effects of evaporated-fuel processing apparatus 11 according to the present embodiment are explained below with reference to FIG. 5, which is a timing diagram indicating a timing at which convergence is determined based on the level of the tank internal pressure in contrast with a timing at which convergence is determined based on time variations of the tank internal pressure. The graph of "Lid switch" in FIG. 5 corresponds to the graph of "Lid switch" in FIG. 4A and the graph of "Lid switch" in FIG. 4B, the graph of "Sealing valve" in FIG. 5 corresponds to the graph of "Sealing valve" in FIG. 4A and the graph of "Sealing valve" in FIG. 4B, the graph of "Pdt" in FIG. 5 corresponds to the graph of "Pdt" in FIG. 4A and the graph of "Pdt" in FIG. 4B, and the graph of "Lid-locking mechanism" in FIG. 5 corresponds to the graph of "Lid-locking mechanism" in FIG. 4A and the graph of "Lid-locking mechanism" in FIG. 4B. Therefore, explanations on the graphs "Lid switch", "Sealing valve", "Pdt" and "Lid-locking mechanism" in FIG. 5 are not presented below. The graph of "Ptank" in FIG. 5 illustrates a gradual decrease of the tank internal pressure Ptank to a vicinity of the atmospheric pressure Patm triggered by the event in which the sealing valve 41 is opened at the time t1.

The evaporated-fuel processing apparatus 11 having the feature according to the aforementioned first aspect of the present invention includes the sealing valve 41, the fuel lid 25, the refueling-intention-information acquisition unit 61, and the controller 69. The sealing valve 41 is arranged in the evaporated-fuel discharge path 37 between the atmosphere and the fuel tank 13 mounted on the vehicle having the internal combustion engine, and shuts the fuel tank 13 off from the atmosphere. The fuel lid 25 covers the fuel filling port 19*b* of the fuel tank 13. The refueling-intention-information acquisition unit 61 acquires the information indicating presence of an intention of refueling. When the refueling-intention-information acquisition unit 61 acquires the information indicating presence of an intention of refueling, the controller 69 issues a command to cause the sealing valve 41 to open. In addition, When the first elapsed time PT1 from the moment (t1) at which the opening command for the sealing valve 41 is issued exceeds the first predetermined time PTth1 (as indicated in the graph of "Pdt" in FIG. 5), the controller 69 allows the fuel lid (open/close member) 25 to open.

That is, in the evaporated-fuel processing apparatus 11 having the feature according to the first aspect of the present invention, the controller 69 issues the command to open the sealing valve 41 when the refueling-intention-information acquisition unit 61 acquires the information indicating presence of an intention of refueling, and allows the fuel lid (open/close member) 25 to open when the first elapsed time PT1 from the moment (t1) at which the opening command for the sealing valve 41 is issued exceeds the first predetermined time PTth1. This is because when the first elapsed time PT1 exceeds the first predetermined time PTth1, the tank internal pressure Ptank can be expected to converge at such a level that refueling is not harmfully affected by the tank internal pressure Ptank.

The evaporated-fuel processing apparatus 11 having the feature according to the first aspect of the present invention enables refueling so as to prevent air pollution without especially referring to the tank internal pressure Ptank.

The evaporated-fuel processing apparatus 11 according to the aforementioned second aspect of the present invention has the following additional feature as well as the features of the first aspect of the present invention. The evaporated-fuel processing apparatus 11 according to the second aspect of the present invention further includes the tank-internal-pressure sensor (tank-internal-pressure detection unit) 39, which detects the tank internal pressure Ptank in the fuel tank 13. In addition, the controller 69 allows the fuel lid (open/close member) 25 to open when the tank internal pressure Ptank converges in a predetermined pressure range and the first elapsed time PT1 exceeds the first predetermined time PTth1. Specifically, the controller 69 allows the fuel lid 25 to open when both of the tank-internal-pressure sensor 39 and the first timer 69*a* normally operate, where the first timer 69*a* counts the first elapsed time PT1.

Thus, the evaporated-fuel processing apparatus 11 having the feature according to the second aspect of the present invention has the advantages of the first aspect of the present invention, and further realizes a fail-safe function in a sense that the fuel lid 25 is not incautiously opened.

The evaporated-fuel processing apparatus 11 according to the aforementioned third aspect of the present invention has the following additional feature as well as the features of the second aspect of the present invention. In the evaporated-fuel processing apparatus 11 according to the third aspect of the present invention, the first predetermined time PTth1 is set on the basis of a time estimated to be needed for convergence of the tank internal pressure Ptank in the predetermined pressure range after the sealing valve 41 is opened.

Thus, the evaporated-fuel processing apparatus 11 having the feature according to the third aspect of the present invention has the advantages of the second aspect of the present invention, and further enables control of opening of the fuel lid 25 at appropriate timing since the first predetermined time PTth1 is set to an appropriate length of time.

The evaporated-fuel processing apparatus 11 according to the aforementioned fourth aspect of the present invention has the following additional feature as well as the features of the second aspect of the present invention. In the evaporated-fuel processing apparatus 11 according to the fourth aspect of the present invention, the first predetermined time PTth1 is set on the basis of a time estimated to be needed for the sealing valve 41 to be actually opened after the opening command is issued.

Thus, the evaporated-fuel processing apparatus 11 having the feature according to the fourth aspect of the present invention has the advantages of the second aspect of the present invention, and also enables control of opening of the fuel lid 25 at appropriate timing, on the basis of the delay time which occurs when the sealing valve 41 is opened.

The evaporated-fuel processing apparatus 11 according to the aforementioned fifth aspect of the present invention has the following additional feature as well as the features of the first aspect of the present invention. The evaporated-fuel processing apparatus 11 according to the fifth aspect of the present invention further includes the tank-internal-pressure sensor (tank-internal-pressure detection unit) 39 and the time-variation calculation unit 67. The tank-internal-pressure sensor 39 detects the tank internal pressure Ptank in the fuel tank 13, and the time-variation calculation unit 67 calculates the time variation Pdt of the tank internal pressure Ptank. In addition, the controller 69 issues an opening command for opening the sealing valve 41 when the refueling-intention-information acquisition unit 61 acquires the information indicating presence of an intention of refueling, and allows the fuel lid (open/close member) 25 to open when the time variation Pdt of the tank internal pressure Ptank converges below the predetermined variation threshold Pdt_th.

In the evaporated-fuel processing apparatus 11 having the feature according to the fifth aspect of the present invention, when the refueling-intention-information acquisition unit 61 acquires the information indicating presence of an intention of refueling, the controller 69 issues the opening command for opening the sealing valve 41, and allows the fuel lid (open/close member) 25 to open when the time variation Pdt of the tank internal pressure Ptank converges below the predetermined variation threshold Pdt_th.

The time variation Pdt of the tank internal pressure Ptank can be calculated, for example, by obtaining a time derivative of the tank internal pressure Ptank, which varies with time. (See, for example, the graphs "Ptank" and "Pdt" in FIG. 5.) Therefore, the scattering of the time variation Pdt is smoothed. Although the scattering of detected values of the tank internal pressure Ptank can cause errors in determination of convergence of the tank internal pressure Ptank, such errors can be more suppressed in the case where convergence is determined on the basis of the time variation Pdt of the tank internal pressure Ptank (as indicated in the graph "Pdt" in FIG. 5) than in the case where convergence is determined on the basis of the level of the tank internal pressure Ptank (as indicated in the graph "Ptank" in FIG. 5).

In the evaporated-fuel processing apparatus 11 having the feature according to the fifth aspect of the present invention, refueling with prevention of air pollution can be performed smoothly and appropriately, compared with the configuration without the feature according to the fifth aspect of the present invention.

In addition, it is possible to expect that the timing of convergence determination based on the tank internal pressure Ptank is earlier in the case where convergence is determined on the basis of the time variation Pdt of the tank internal pressure Ptank, than in the case where convergence is determined on the basis of the level of the tank internal pressure Ptank. (The timings of the convergence determination in the above cases are indicated in the graphs "Pdt" and "Ptank" in FIG. 5.) This is because the time variation Pdt of the tank internal pressure Ptank shows a tendency to a convergence of the tank internal pressure Ptank to a vicinity of the atmospheric pressure at an earlier time than the level of the tank internal pressure Ptank.

In the evaporated-fuel processing apparatus 11 having the feature according to the fifth aspect of the present invention, refueling with prevention of air pollution can be performed smoothly and quickly perform with short wait time.

Further, in the evaporated-fuel processing apparatus 11 having the feature according to the fifth aspect of the present invention, it is possible to expect a secondary effect of avoiding occurrence of a situation in which unlocking of the lid-locking mechanism 27 is impossible, even in the case where a failure in which the detected value of the tank-internal-pressure sensor 39 is stuck occurs. This is because the time variation Pdt of the tank internal pressure Ptank converges below the predetermined variation threshold Pdt_th in the failure mode in which the detected value of the tank-internal-pressure sensor 39 is stuck.

The evaporated-fuel processing apparatus 11 according to the aforementioned sixth aspect of the present invention has the following additional feature as well as the features of the fifth aspect of the present invention. In the evaporated-fuel processing apparatus 11 according to the sixth aspect of the present invention, the controller 69 causes the time-variation calculation unit 67 to start calculation of the time variation Pdt of the tank internal pressure Ptank after the first elapsed time PT1 from the moment at which the opening command for the sealing valve 41 is issued exceeds the first predetermined time PTth1 (as indicated in the graph of "Pdt" in FIG. 5).

Immediately after the sealing valve 41 is opened, the tank internal pressure varies (is lowered) relatively greatly. Therefore, even if the time variation Pdt of the tank internal pressure Ptank is calculated in an initial variation period immediately after the sealing valve 41 is opened, it is unlikely that the tank internal pressure Ptank is determined to converge. Thus, it is possible to consider that the convergence determination on the basis of the tank internal pressure is little affected even in the case where the time variation Pdt of the tank internal pressure Ptank is not calculated in the initial variation period.

In consideration of the above, according to the sixth aspect of the invention, the controller 69 causes the time-variation calculation unit 67 to start calculation of the time variation Pdt of the tank internal pressure Ptank after the first elapsed time PT1 from the moment at which the opening command for the sealing valve 41 is issued exceeds the first predetermined time PTth1. It is possible to set as the first predetermined time PTth1 an appropriate length of time containing the initial variation period immediately after opening of the sealing valve 41.

In the evaporated-fuel processing apparatus 11 having the feature according to the sixth aspect of the present invention, the calculation of the time variation Pdt of the tank internal pressure Ptank is not performed in the interval from the moment at which the opening command for the sealing valve 41 is issued until the first elapsed time PT1 exceeds the first predetermined time PTth1 (including the aforementioned initial variation period). That is, the unnecessary process for calculating the time variation is dispensed with. Therefore, the evaporated-fuel processing apparatus 11 having the feature according to the sixth aspect of the present invention has an advantage of contribution to energy saving, in addition to the advantages of the fifth aspect of the present invention.

The evaporated-fuel processing apparatus 11 according to the aforementioned seventh aspect of the present invention has the following additional feature as well as the features of the fifth aspect of the present invention. In the evaporated-fuel processing apparatus 11 according to the seventh aspect of the present invention, the first predetermined time PTth1 is set on the basis of a time estimated to be needed for convergence of the time variation Pdt of the tank internal pressure Ptank below the predetermined variation threshold Pdt_th after the sealing valve 41 is opened.

In the evaporated-fuel processing apparatus 11 having the feature according to the seventh aspect of the present invention, the unnecessary process for calculating the time variation is dispensed with as much as possible. Therefore, the evaporated-fuel processing apparatus 11 having the feature according to the seventh aspect of the present invention has an advantage of further contribution to energy saving, in addition to the advantages of the fifth aspect of the present invention.

The evaporated-fuel processing apparatus 11 according to the aforementioned eighth aspect of the present invention has the following additional feature as well as the features of the first aspect of the present invention. The evaporated-fuel processing apparatus 11 according to the eighth aspect of the present invention further includes the tank-internal-pressure sensor (tank-internal-pressure detection unit) 39 and the lid sensor (open/closed-state detecting part) 29. The tank-internal-pressure sensor 39 detects the tank internal pressure Ptank in the fuel tank 13, and the lid sensor 29 detects the open/closed state of the fuel lid (open/close member) 25. In addition, the controller 69 issues an opening command for opening the sealing valve 41 when the refueling-intention-information acquisition unit 61 acquires the information indicating presence of an intention of refueling, and allows the fuel lid (open/close member) 25 to open when the tank internal pressure Ptank converges in a predetermined pressure range satisfying Ptank<Ptank_th. Further, the controller 69 causes the sealing valve 41 to be maintained in the open state when the lid sensor 29 detects that the fuel lid 25 transitions from the open state to the closed state.

In the evaporated-fuel processing apparatus 11 having the feature according to the eighth aspect of the present invention, the controller 69 causes the sealing valve 41 to be maintained in the open state when the lid sensor 29 detects that the fuel lid 25 transitions from the open state to the closed state. Therefore, even when the operator touches an open/closed-state detecting part in the lid sensor 29 by mistake during refueling, the sealing valve 41 is maintained in the open state (i.e., the sealing valve 41 is not closed). As a result, refueling with prevention of air pollution can be performed smoothly and appropriately, compared with the configuration without the feature according to the eighth aspect of the present invention.

The evaporated-fuel processing apparatus 11 according to the aforementioned ninth aspect of the present invention has the following additional feature as well as the features of the eighth aspect of the present invention. The evaporated-fuel processing apparatus 11 according to the ninth aspect of the present invention further includes the running-state-information acquisition unit 65, which acquires the information on the running state of the vehicle. When the running-state-information acquisition unit 65 acquires information indicating that the vehicle starts running, the controller 69 issues a command to close the sealing valve 41.

In the evaporated-fuel processing apparatus 11 having the feature according to the ninth aspect of the present invention, the event in which the vehicle starts running triggers closing of the sealing valve 41. Therefore, it is possible to appropriately set and control the close timing of the sealing valve 41. In addition, the evaporated-fuel processing apparatus 11 having the feature according to the ninth aspect of the present invention also has the advantages of the eighth aspect of the present invention.

The evaporated-fuel processing apparatus 11 according to the aforementioned tenth aspect of the present invention has the following additional feature as well as the features of the eighth aspect of the present invention. The evaporated-fuel processing apparatus 11 according to the tenth aspect of the present invention further includes the running-state-information acquisition unit 65, which acquires the information on the running state of the vehicle. When the second elapsed time PT2 (i.e., the time elapsed from the moment of acquisition, by the refueling-intention-information acquisition unit 61, of the information indicating presence of an intention of refueling) exceeds the second predetermined time PTth2, the controller 69 issues a command to close the sealing valve 41.

In the evaporated-fuel processing apparatus 11 having the feature according to the tenth aspect of the present invention, the event in which the second elapsed time PT2 (i.e., the time elapsed from the moment of acquisition of the information indicating presence of an intention of refueling) exceeds the second predetermined time PTth2 triggers closing of the sealing valve 41. Therefore, it is possible to appropriately set and control the close timing of the sealing valve 41. In addition, the evaporated-fuel processing apparatus 11 having the feature according to the tenth aspect of the present invention also has the advantages of the eighth aspect of the present invention.

The evaporated-fuel processing apparatus 11 according to the aforementioned eleventh aspect of the present invention has the following additional feature as well as the features of the eighth aspect of the present invention. The evaporated-fuel processing apparatus 11 according to the eleventh aspect of the present invention further includes the informing unit 57, which provides the driver or the operator with information about refueling. In addition, the controller 69 causes the informing unit 57 to provide the driver or the operator with the information indicating allowance of refueling, in the period from the moment at which the fuel lid 25 is allowed to open until the moment at which the open/closed-state-information acquisition unit 63 acquires information indicating that the lid sensor 29 detects a transition of the fuel lid 25 from the open state to the closed state.

In the evaporated-fuel processing apparatus 11 having the feature according to the eleventh aspect of the present invention, the information indicating allowance of refueling is provided to the driver or the operator in the period from the moment of opening to the moment of closing of the fuel lid 25. Therefore, it is possible to improve the convenience in refueling. In addition, the evaporated-fuel processing apparatus 11 having the feature according to the eleventh aspect of the present invention also has the advantages of the eighth aspect of the present invention.

The evaporated-fuel processing apparatus 11 according to the aforementioned twelfth aspect of the present invention has the following additional feature as well as the features of the ninth aspect of the present invention. The evaporated-fuel processing apparatus 11 according to the twelfth aspect of the present invention further includes the informing unit 57, which provides the driver or the operator with information about refueling. In addition, the controller 69 causes the informing unit 57 to provide the driver or the operator with the alarm information indicating that the fuel lid (open/close member) 25 is in the open state, in the period from the moment at which a command to close the sealing valve 41 is issued until the moment at which the open/closed-state-information acquisition unit 63 acquires information indicating that the fuel lid 25 transitions from the open state to the closed state.

In the evaporated-fuel processing apparatus 11 having the feature according to the twelfth aspect of the present invention, the alarm information indicating that the fuel lid (open/close member) 25 is in the open state is provided to the driver or the operator in the period from the moment at which the sealing valve 41 is closed until the moment at which the open/closed-state-information acquisition unit 63 acquires information indicating that the fuel lid 25 transitions from the open state to the closed state. Therefore, it is possible to appropriately prevent the operator from forgetting to close the fuel lid 25. In addition, the evaporated-fuel processing apparatus 11 having the feature according to the twelfth aspect of the present invention also has the advantages of the ninth aspect of the present invention.

Other Embodiments

The embodiment explained above is an example of a realization of the present invention. Therefore, the technical scope of the present invention should not be construed as being limited by the explained embodiment. The present invention can be realized in various forms without departing from the spirit and scope of the invention.

For example, in the explained embodiment, the operations of determination in step S18A and 18B (as to whether or not the vehicle starts running, or whether or not the time elapsed from the moment of acquisition of the information indicating presence of an intention of refueling exceeds the second predetermined time) are inserted before the issue by the controller 69 of the command to close the sealing valve 41 in step S19 after the determination in step S17 that the fuel lid 25 is closed after being opened. However, the present invention is not limited to the above example. That is, according to the present invention, the operations in steps S18A and S18B may be dispensed with. In this case, immediately after the determination in step S17 that the fuel lid 25 is closed after being opened, the controller 69 issues the command to close the sealing valve 41 in step S19.

In addition, in the explained embodiment, the evaporated-fuel processing apparatus 11 is assumed to be applied to a hybrid vehicle having an internal combustion engine and one or more electric motors as driving power sources. However, the present invention is not limited to such an example. For example, the present invention can be applied to vehicles which have only one internal combustion engine or only one or more electric motors.

Further, in the explained embodiment, the evaporated-fuel processing apparatus 11 is assumed to be applied to a vehicle having the filler cap 23 on the fuel filling port 19*b*. However, the present invention is not limited to such an example. For example, the present invention can be applied to vehicles having the so-called capless structure, in which no filler cap 23 is arranged on the fuel filling port 19*b*.

Furthermore, in a first variation of the explained embodiment, unlocking of the fuel lid 25 is triggered by the event in which the time variation Pdt of the tank internal pressure Ptank converges below the predetermined variation threshold Pdt_th and the tank internal pressure Ptank converges below a first predetermined threshold for the tank internal pressure. (The tank internal pressure Ptank is detected by the tank-internal-pressure sensor 39.) The first predetermined threshold for the tank internal pressure can be appropriately set to, for example, a value in a vicinity of the atmospheric pressure so as to prevent emission of the evaporated fuel through the fuel filling port 19*b* to the atmosphere while the fuel lid 25 is open. In the case where the evaporated-fuel processing apparatus is configured as above, it is possible to prevent emission of the evaporated fuel through the fuel filling port 19*b* to the atmosphere even when the fuel lid 25 is open.

Alternatively, in a second variation of the explained embodiment, unlocking of the fuel lid 25 is triggered by the event in which the tank internal pressure Ptank is lowered by opening of the sealing valve 41 to a value in a vicinity of the atmospheric pressure in a predetermined time threshold while the tank internal pressure Ptank (detected by the tank-internal-pressure sensor 39) is over a second predetermined threshold for the tank internal pressure. The second predetermined threshold for the tank internal pressure may be appropriately set to a relatively high value such that more than an allowable amount of evaporated fuel can be emitted through the fuel filling port 19*b* to the atmosphere if the fuel lid 25 is opened. In addition, the predetermined time threshold can be appropriately set on the basis of the length of time which is normally needed for lowering the tank internal pressure Ptank from the second predetermined threshold value to the vicinity of the atmospheric pressure by opening of the sealing valve 41. In the case where the evaporated-fuel processing apparatus is configured as above, similar in the first variation, it is possible to prevent emission of the evaporated fuel through the fuel filling port 19*b* to the atmosphere even when the fuel lid 25 is open, and smoothly and appropriately perform refueling so as to prevent air pollution.

In one of the explained examples, the controller 69 allows the fuel lid 25 to open when the tank internal pressure Ptank converges in the predetermined pressure range (satisfying Ptank<Ptank_th). However, the convergence of the tank internal pressure Ptank in the predetermined pressure range includes the convergence of the time variation Pdt of the tank internal pressure Ptank calculated by the time-variation calculation unit 67 below the predetermined threshold. The predetermined threshold for the time variation Pdt of the tank internal pressure Ptank is set to such a (small) amount that the tank internal pressure Ptank can be regarded as converging in a vicinity of the atmospheric pressure. Based on the above configuration based on the convergence, it is possible to reduce the wait time until unlocking of the lid-locking mechanism 27 after the moment at which the lid switch 31 is manipulated to be turned on.

Further, an evaporated-fuel processing apparatus according to the present invention may be configured as follows. That is, a canister-internal-pressure sensor (not shown) for detecting the internal pressure of the canister 15 is arranged in the canister 15. The value of the internal pressure of the canister 15 detected by the canister-internal-pressure sensor is sent to the ECU 17. The ECU 17 estimates the amount of the evaporated fuel absorbed in the canister 15, on the basis of the detected value of the internal pressure of the canister 15 and other information, and determines, on the basis of the result of the estimation, the probability that an amount of the evaporated fuel equivalent to the allowable absorption amount of the canister 15 is already absorbed by the canister 15. When the ECU 17 determines the above probability to be high, and the lid switch 31 is manipulated to be turned on for closing the fuel lid 25, the ECU 17 controls the sealing valve 41 to close (not to maintain the open state of the sealing valve 41), because if the open state of the sealing valve 41 is maintained the evaporated fuel is emitted to the atmosphere without being absorbed by the canister 15. In addition, when the ECU 17 determines the above probability to be high, the ECU 17 may perform control so as to reduce the wait time until the lid-locking mechanism 27 is unlocked after the lid switch 31 is manipulated to be turned on. In the case where the evaporated-fuel processing apparatus is configured as above, it is possible to prevent emission of the evaporated fuel to the atmosphere even, and smoothly perform refueling so as to prevent air pollution.

What is claimed is:

1. An evaporated-fuel processing apparatus comprising:

a sealing valve which is arranged in a communication path between atmosphere and a fuel tank mounted on a vehicle having an internal combustion engine, and shuts an internal space of the fuel tank off from the atmosphere;

an open/close member which covers a fuel filling port of the fuel tank;

a tank-internal-pressure detection unit which detects an internal pressure of the fuel tank;

an open/closed-state detection unit which detects an open/closed state of the open/close member;

a refueling-intention-information acquisition unit which acquires information indicating an intention of refueling;

a running-state-information acquisition unit which acquires information on a running state of the vehicle;

a control unit which issues an opening command for opening the sealing valve when the refueling-intention-information acquisition unit acquires the information indicating an intention of refueling, and allows the open/close member to open when a time elapsed from a moment at which the opening command is issued exceeds a first predetermined time; and an informing unit which provides an operator with information about refueling, wherein:

the control unit issues the opening command when the refueling-intention-information acquisition unit acquires the information indicating the intention of refueling, allows the open/close member to open when the internal pressure of the fuel tank converges in a predetermined pressure range, and maintains the sealing valve in an open state when the open/closed-state detection unit detects that the open/closed state of the open/close member transitions from an open state to a closed state, and causes the informing unit to provide the operator with alarm information indicating that the open/close member is in the open state, in a period from a moment at which the control unit issues the command to close the sealing valve until a moment at which the open/closed-state detection unit detects a transition of the open/close state of the open/close member from the open state to the closed state, and wherein the control unit issues a command to close the sealing valve when the running-state-information acquisition unit acquires information indicating that the vehicle starts running.

2. The evaporated-fuel processing apparatus according to claim 1, wherein the first predetermined time is set on the basis of a length of time which is estimated to be needed for convergence of the internal pressure of the fuel tank in the predetermined pressure range after the sealing valve is opened.

3. The evaporated-fuel processing apparatus according to claim 1, wherein the first predetermined time is set on the basis of a length of time which is estimated to be needed for the sealing valve to actually open after the opening command is issued.

4. The evaporated-fuel processing apparatus according to claim 1, further comprising a time-variation calculation unit which calculates an amount of time variation of the internal pressure of the fuel tank, wherein the control unit allows the open/close member to open when the amount of time variation of the internal pressure of the fuel tank converges below a predetermined threshold.

5. The evaporated-fuel processing apparatus according to claim 4, wherein the control unit causes the time-variation calculation unit to start calculation of the amount of time variation of the internal pressure of the fuel tank after the time elapsed from the moment at which the opening command is issued exceeds the first predetermined time.

6. The evaporated-fuel processing apparatus according to claim 4, wherein the first predetermined time is set on the basis of a length of time which is estimated to be needed for convergence of the amount of time variation of the internal pressure of the fuel tank below the predetermined threshold after the sealing valve is opened.

7. The evaporated-fuel processing apparatus according to claim 1, further comprising a running-state-information acquisition unit which acquires information on a running state of the vehicle, wherein the control unit issues a command to close the sealing valve when a time elapsed from a moment at which the refueling-intention-information acquisition unit acquires the information indicating an intention of refueling exceeds a second predetermined time.

8. The evaporated-fuel processing apparatus according to claim 1, wherein the control unit causes the informing unit to provide the operator with information indicating that refueling is allowed, in a period from a moment at which the open/close member is allowed to open until a moment at which the open/closed-state detection unit detects a transition of the open/close state of the open/close member from the open state to the closed state.

* * * * *